US010591212B2

(12) United States Patent
Lallouet

(10) Patent No.: US 10,591,212 B2
(45) Date of Patent: Mar. 17, 2020

(54) DEVICE AND METHOD FOR DRYING GRAIN

(71) Applicant: CERES, La Chapelle Lasson (FR)

(72) Inventor: M. Laurent Lallouet, Equemauville (FR)

(73) Assignee: CERES, La Chapelle Lasson (FR)

( * ) Notice: Subject to any disclaimer, the term of this patent is extended or adjusted under 35 U.S.C. 154(b) by 161 days.

(21) Appl. No.: 15/940,608

(22) Filed: Mar. 29, 2018

(65) Prior Publication Data

US 2018/0216883 A1 Aug. 2, 2018

Related U.S. Application Data

(63) Continuation-in-part of application No. 14/207,271, filed on Mar. 12, 2014, now abandoned.

(51) Int. Cl.

| | |
|---|---|
| ***F26B 17/14*** | (2006.01) |
| ***F26B 21/00*** | (2006.01) |
| ***F26B 25/00*** | (2006.01) |
| ***F26B 21/04*** | (2006.01) |
| ***F26B 17/12*** | (2006.01) |

(52) U.S. Cl.

CPC ..... *F26B 17/14* (2013.01); *F26B 17/122* (2013.01); *F26B 21/003* (2013.01); *F26B 21/04* (2013.01); *F26B 25/005* (2013.01); *F26B 25/007* (2013.01); *F26B 2200/06* (2013.01)

(58) Field of Classification Search

CPC ..... F26B 21/003; F26B 17/12; F26B 21/04; F26B 25/005; F26B 17/14; F26B 2200/06; F26B 17/122; D06F 58/22; B01D 36/001

USPC ..... 34/480

See application file for complete search history.

(56) References Cited

U.S. PATENT DOCUMENTS 707,323 A * 8/1902 Hess, Jr. ..... F26B 17/122 34/65
1,127,974 A * 2/1915 Ellis ..... F26B 17/122 34/65

(Continued)

FOREIGN PATENT DOCUMENTS

CN 201179398 Y 1/2009
FR 2049941 A5 3/1971

(Continued)

*Primary Examiner* — David J Laux
*Assistant Examiner* — Bao D Nguyen
(74) *Attorney, Agent, or Firm* — Craft Chu PLLC; Andrew W. Chu

(57) ABSTRACT

A device for drying grain includes a housing having an inlet port and an outlet port, a first passageway, a second passageway, a grain flow housing, a filter across the grain flow housing, a recovery column, an air supply, a recycle column, a filter cleaner in the recovery column, and a conveyor for moving the filter cleaner along the filter. The air supply pulls an air flow into the housing through the inlet port as a grain flow pours through the grain flow housing. The air flow passes through the grain flow in a first pass air flow from the passageways to dry the grain. The first pass air flow passes through the filter to remove particles, and a portion of that filtered first pass air flow is recycled back with the filter cleaner to dislodge particles clogging the filter. The other portion is vented through the outlet port.

20 Claims, 5 Drawing Sheets

(56) References Cited

U.S. PATENT DOCUMENTS 1,151,268 A * 8/1915 Hess ..... F26B 17/122 34/65
1,210,166 A * 12/1916 Hess ..... F26B 17/122 34/169
2,422,825 A * 6/1947 Davis, Jr. ..... D06F 58/22 34/82
3,061,942 A * 11/1962 Scofield ..... D06F 58/22 34/82
3,325,912 A * 6/1967 Bojner ..... F26B 17/126 34/169
4,048,727 A * 9/1977 Botkins ..... F26B 17/122 34/393
4,125,945 A * 11/1978 Westelaken ..... A23B 9/08 34/167
4,314,409 A * 2/1982 Cartier ..... D06F 58/22 34/604
4,462,170 A * 7/1984 Burkall ..... D06F 58/22 34/605
4,486,960 A * 12/1984 Maurice ..... F26B 17/122 34/167
4,507,875 A * 4/1985 Hirsch ..... G01N 7/00 236/44 C
4,523,388 A * 6/1985 Cuel ..... A23L 3/40 34/169
4,555,858 A * 12/1985 Hegedus ..... F26B 17/122 34/483
4,563,200 A * 1/1986 Gladstone ..... B01D 46/0043 55/294
4,690,700 A * 9/1987 Howeth ..... B01D 46/0043 137/625.48
4,700,492 A * 10/1987 Werner ..... D06F 58/22 34/403
4,726,125 A * 2/1988 Pellerin ..... D06F 58/22 34/191
6,267,587 B1 * 7/2001 Bishop ..... F26B 11/18 414/147
6,311,411 B1 * 11/2001 Clark ..... F26B 17/002 34/174
7,574,816 B2 * 8/2009 Shivvers ..... F26B 3/205 34/333
2006/0075577 A1 * 4/2006 Jeong ..... D06F 25/00 8/158
2006/0143939 A1 * 7/2006 Bouman ..... B01D 1/18 34/443
2007/0294911 A1 * 12/2007 Wilson ..... C10F 5/00 34/165
2008/0011440 A1 * 1/2008 Rajanummi ..... B01D 46/0065 162/272
2008/0148943 A1 * 6/2008 Blair ..... B01D 46/0006 95/286
2008/0184589 A1 * 8/2008 Shivvers ..... F26B 3/08 34/504
2009/0031513 A1 * 2/2009 Goldberg ..... D06F 58/20 15/88.4
2010/0107439 A1 * 5/2010 Shivvers ..... F26B 17/122 34/477
2010/0155326 A1 * 6/2010 Grunert ..... D06F 58/22 210/507
2011/0271543 A1 * 11/2011 Kim ..... D06F 58/22 34/90
2011/0277336 A1 * 11/2011 Shin ..... D06F 58/22 34/130
2013/0071287 A1 * 3/2013 O'Connell ..... A23B 9/18 422/37
2013/0212894 A1 * 8/2013 Kim ..... F26B 21/003 34/82
2013/0219734 A1 * 8/2013 Kim ..... F26B 21/003 34/82
2013/0219735 A1 * 8/2013 Beaumont ..... F26B 21/003 34/82
2013/0276327 A1 * 10/2013 Doh ..... D06F 29/005 34/480
2015/0260455 A1 9/2015 Lallouet
2016/0153136 A1 * 6/2016 Yoichi ..... D06F 58/22 34/82

FOREIGN PATENT DOCUMENTS

FR 2444909 A1 * 7/1980 ..... F26B 17/1416
FR 2476820 A1 * 8/1981 ..... F26B 17/1416
FR 2480920 A2 * 10/1981 ..... F26B 17/1416
FR 2630621 A1 * 11/1989 ..... F26B 17/122
FR 2661313 A1 * 10/1991 ..... A01F 25/08
FR 2675569 A1 * 10/1992 ..... F26B 17/122
FR 2994101 A1 * 2/2014
JP 11124232 A 5/1999
JP 2000001224 A 1/2000
RU 2191061 C1 10/2002
WO WO-2010062359 A1 * 6/2010 ..... F26B 17/122

* cited by examiner 10
14
16
106
-48-
80
102
100
-46-
90
40
50
-44-
52
30
56
20
-42-
12
54

FIG. 4
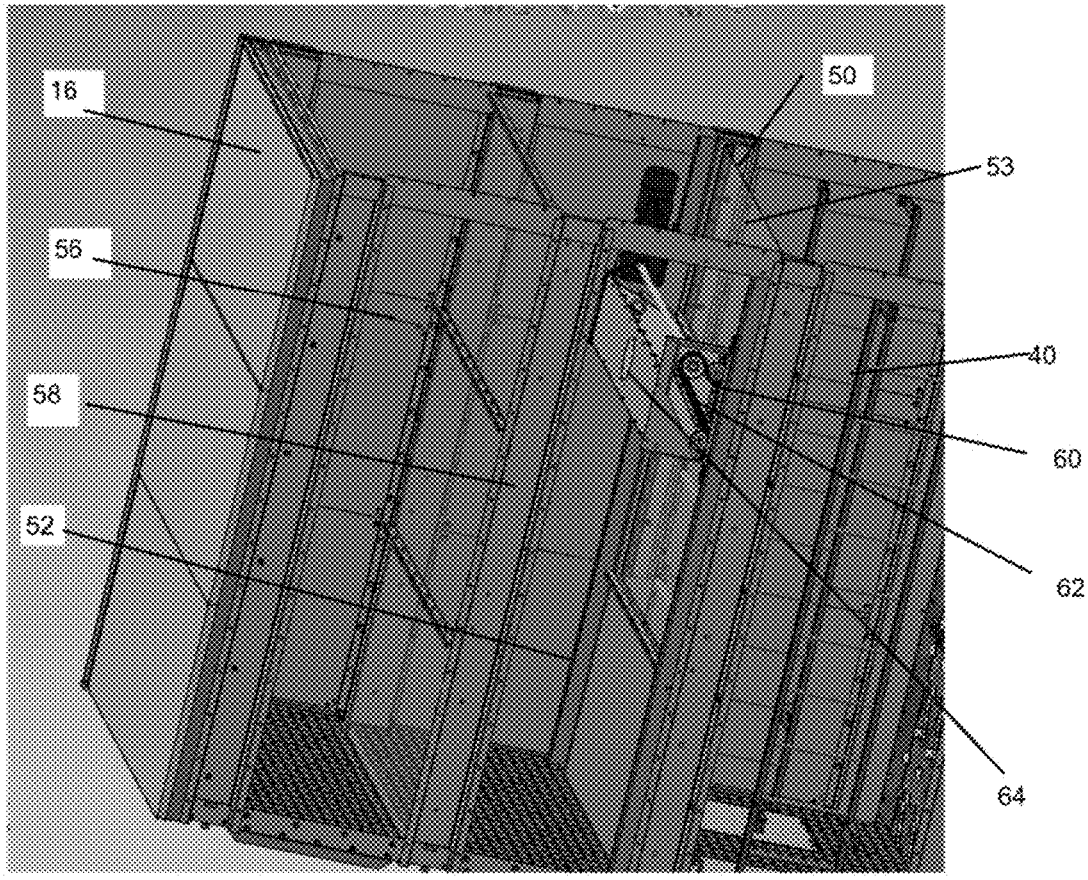
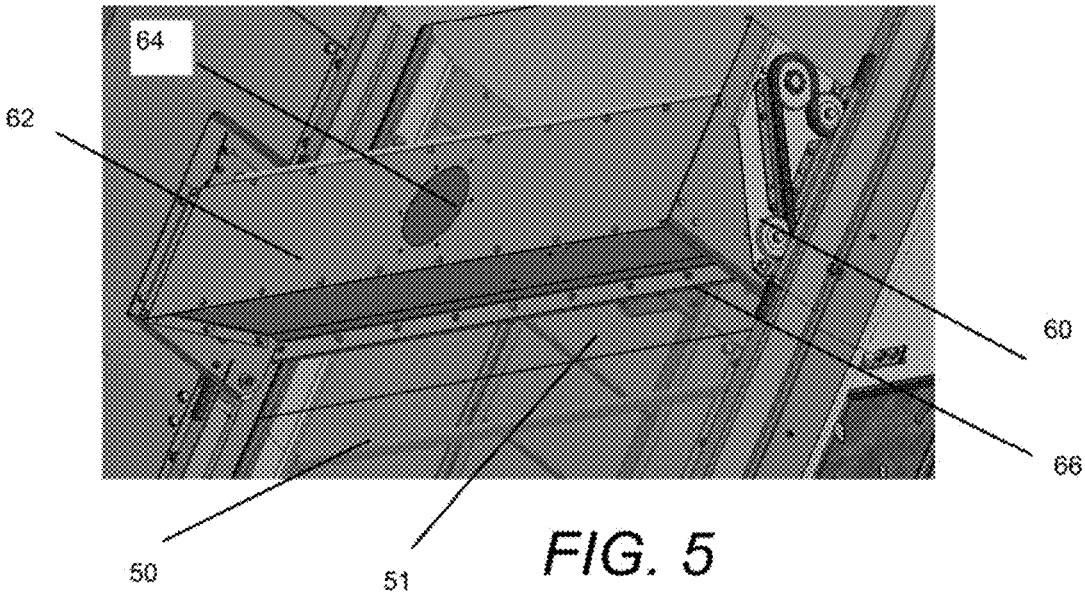
FIG. 5

DEVICE AND METHOD FOR DRYING GRAIN

CROSS-REFERENCE TO RELATED APPLICATIONS

The present application claims continuation-in-part priority under 35 U.S.C. § 120 from U.S. Ser. No. 14/207,271, filed on 12 Mar. 2014, and entitled "METHOD FOR FILTERING AN AIR FLOW IN A GRAIN DRYER".

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention is related to the field of agricultural machine equipment. In particular, the present invention relates to grain dryers. More particularly, the present invention relates to a method and device for flowing an air stream through a grain flow, passing the air stream through a filter after passing through the grain flow so as to form a filtered air stream, and recycling a portion of the filtered air stream to clean the filter.

2. Description of Related Art Including Information Disclosed Under 37 CFR 1.97 and 37 CFR 1.98

A grain dryer is used after grains are harvested. When the grains are harvested from the base of the plant, the grains have not had enough time to dry sufficiently. The presence of residual moisture inside the grains can be problematic for storing the grains. The moisture promotes fermentation and oxidation. Therefore, the use of a grain dryer, after the harvest, is essential in order to be able to store the grain under optimal conditions and to avoid any degradation of the grain.

Traditionally, a grain dryer for this type of application is comprised of at least one column, in which the grains can flow, namely by gravity. The grains are deposited in bulk at the level of the upper portion of the column; the grains fall through the column; and then, the grains are collected at the lower portion as dried grains.

Along the path inside the drying column, the grains contact the air inside the drying column. The air can have a controlled temperature, usually higher than the temperature of the grain. Traditionally, the air in the drying column can also be circulated so as to maintain a consistent temperature and remove particles, after passing through and drying the grains.

The recycling of the air in the traditional grain dryers is generally allowed by installing at least one filter, for example "bag filters", often used in industrial environments. More particularly, the bag filters, which can be arranged either horizontally or vertically, permit a separation of the dust transported by an air stream and collected in a conduit.

Patents RU 2191061, JP 2000001224 and JP 11124232 describe the use of bag filters in order to trap the dust from the air stream when recycling the air flowing in a grain dryer.

The bag filters have the advantage of permitting an efficient dust separation; however, these filters the grain dryers must be cleaned, usually by being submitted to dust-removal operations.

A grain dryer having a bag filter must be shut down on average once every week in order to clean the filters that have become clogged by dust. This tedious and labor-intensive operation is necessary. A clogged bag filter can significantly reduce the performance and efficiency of the grain dryer. A clogged bag filter can lead to an increase in energy consumption.

The prior art patent, JP 2000 001224, provides a device into which grains or powders are poured, through a conduit, from a container. At the level of the conduit, an envelope is positioned, which is provided with an air-replacement orifice. At the level of this orifice, a filter is positioned. The outer portion of the filter is covered with a cap connected to a dust collector. A clearance is provided between the cap and the filter so as to permit an inlet of air from outside the device. However, this device does not allow an active drying of the grains or powders by another air flow circulating through the conduit. Therefore, there is no recirculation and recycling of the air flow that air flow through the conduit. Additionally, the same disadvantages of the conventional bag filters are also found in this device.

Other types of filters are described in the state of the art, for example in U.S. Pat. Nos. 4,563,200 and 4,690,700. However, these filters are in no way suitable for grain dryers.

These and other objects and advantages of the present invention will become apparent from a reading of the attached specification and appended claims.

BRIEF SUMMARY OF THE INVENTION

The device for drying grain includes a housing having an inlet port and an outlet port, a first passageway having a first entry end and a first exit end, a first heating means mounted within a second passageway, the second passageway having a second entry end and a second exit end, and a grain flow housing. There is a filter means across the grain flow housing from the first exit end and the second exit end, a recovery column in fluid connection with the grain flow housing through the filter means, an air supplying means in fluid connection with the recovery column and the inlet port, and a recycle column in fluid connection with the air supplying means opposite the recovery column. Additionally, there is a filter cleaning means positioned within the recovery column, and a conveying means within the recovery column. The filter cleaning means includes a mobile blower, a blower intake, and a blower outlet. The conveying means raises and lowers the mobile blower along the filter means.

Embodiments of the present invention include the filtering means as a filter panel extending over at least part of the grain flow housing. There can also be a plurality of filter panels with each panel extending over at least part of the grain flow housing. The filter panel can be planar or comprised of two facets, each facet being contained in a different plane. The air supplying means can be a fan in fluid connection with the inlet port and the outlet port, drawing air by negative pressure through the inlet port and venting through the outlet port by positive pressure. The conveying means can be a pulley system or a motor on a track along the filtering means or the recovery column. As the conveying means moves the mobile blower, the blower intake can be a flexible conduit or a suction cone or baffle to pull air from the recycle column. The blower intake is sealed from the recovery column through a divider between the recovery column and the recycle column.

Alternative embodiments include a third passageway with a second heating means and a fourth passageway with a third heating means. The third and fourth passageways connect to the recycle column so that the device can include a second pass of air flow through the grains in an upper part of the grain flow housing. Another variation of this embodiment includes an upper filter means so that the second pass of air flow can also be filtered before venting through the outlet port of the housing. There is an analogous upper recovery column and upper recycle column. Further embodiments include an upper filter cleaning means to remove particles from the upper filter means. There can be an upper conveying means for aligning the upper filter cleaning means to the upper filter means.

The present invention includes the method for drying grain with the device. Once assembled, an external air flow passes into the housing through the inlet port by the air supplying means with negative pressure. A grain flow is poured through the grain flow housing, and the external air flow passes through the grain flow in a direction perpendicular to a direction of the grain flow so as to form a first pass air flow. The first pass air flow dries the grain in the grain flow. Then, the first pass air flow with first air flow retaining particles is filtered through the filter means so as to form a first filtered air flow in the recovery column. The first air flow retaining particles are retained by the filter means. A first portion of the first filtered flow is directed to the recycle column, and a second portion of the first filtered flow is directed from the recycle column through the filter means toward the grain flow so as to remove the first air flow retaining particles from the filter means. The method includes a conveying means to align the filter cleaning means along the filter means. There is an isolated blow out against the filter means to remove particles from the filter means. The first portion is eventually vented from the recycle column through the outlet port.

Embodiments of the method include passing the external air flow through the first passageway to the grain flow and passing the external air flow through the second passageway to the grain flow. The first heating means can differentiate from a cooling area and a first drying area in the grain flow housing, so a variation of the method includes heating the external air flow through the second passageway.

Additional embodiments of the method include the different components added to the device. When there is a third passageway and a second heating means within the third passageway, the step of directing the first portion of the first filtered flow can include additional steps before venting through the outlet port. There are similar variations when there is a fourth passageway, and a third heating means within the fourth passageway. The first portion can be treated and directed for second and third drying areas in the grain flow housing. The method can include a second pass air flow for drying more grain at the top of the grain flow housing.

Embodiments of the method also include filtering the second pass air flow with an upper filter means and cleaning the upper filter means. There can be the step of aligning the upper filter cleaning means along the upper filter means for removing particles from the upper filter means.

BRIEF DESCRIPTION OF THE SEVERAL VIEWS OF THE DRAWINGS

FIG. 4 is a partial perspective view of the housing, the grain flow housing, recycling column, recovery column, filter means, and another embodiment of the filter cleaning means of the present invention.

FIG. 5 is an isolated partial perspective view of the housing filter cleaning means of FIG. 4.

DETAILED DESCRIPTION OF THE INVENTION

The device and method for drying grain of the present invention recycles air flow, after that air flow has been used as a first pass through the grain flow to dry grain. The recycling happens on two levels: some recycled air flow is used to clean the filter, and some recycled air flow is used for a second pass through the grain flow. There is no re-entry into the device by external air for the second pass. Additionally, the filter is cleaned to maintain efficiency of the filter without any down time. The filter can be cleaned without stopping operation.

FIGS. 1 and 3-6 show embodiments of the device 10 for drying grain, according to the invention. The device 10 comprises a housing 16 having an inlet port 12 and an outlet port 14. The inlet port 12 is in fluid connection with the outlet port 14. External air drawn into the housing 16 at the inlet port 12 is vented or eventually exhausted at the outlet port. There is no other entry of external air, and there is mixing with any of the air flows or filtered air flows in the housing 16. There is a reduction in fire hazard because there is no longer mixing and heating of air flows with particles from the grain flow.

Figure 1:
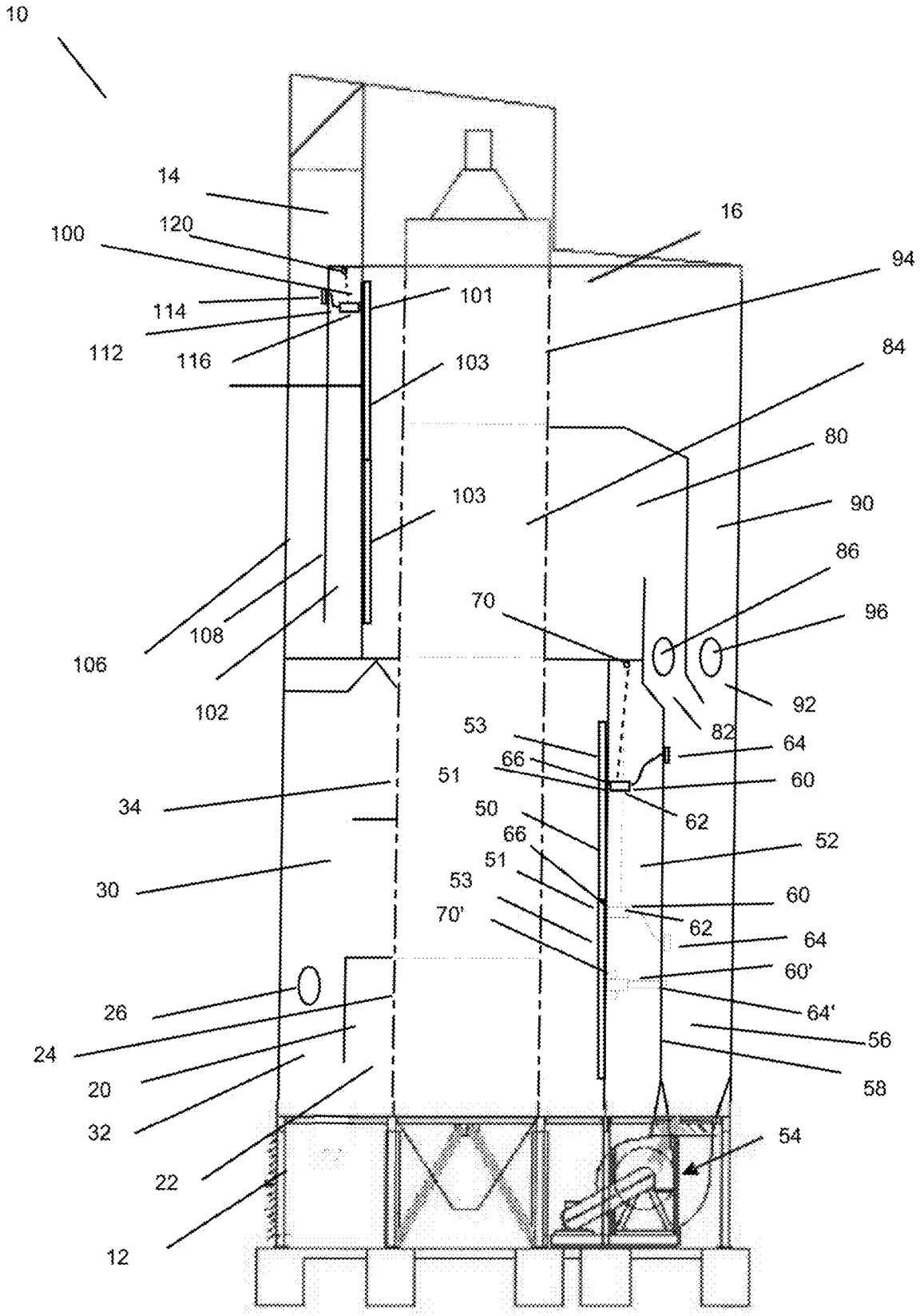
FIG. 1 is a schematic view of an embodiment of the device for drying grain, according to the present invention.

The device 10 also comprises a first passageway 20 having a first entry end 22, a first exit end 24, and a first heating means 26 mounted within a second passageway 30, and the second passageway 30 having a second entry 32 end, and a second exit end 34. The inlet port 12 is in fluid connection with both the first entry end 22 and the second entry end 32. FIG. 1 also shows a grain flow housing 40 being comprised of a cooling area 42, a first drying area 44 above the cooling area 42, a second drying area 46 above the first drying area 44, and a third drying area 48 above the second drying area 46. The first exit end 24 is in fluid connection with the cooling area 42, while the second exit end 34 is in fluid connection with the first drying area 44. The first heating means 26 can increase the temperature of the air so that the grains are dried in the first drying area 42. The first heating means can be any known heater, such as an electric heating element, gas heater, or other heating device.

Across the grain flow housing 40 from the first exit end 24 and the second exit end 34, the device 10 includes a filter means 50. The filtering means 50 is comprised of a filter panel 53 as in FIGS. 4 and 6 or a plurality of filter panels 53 as in FIGS. 1 and 5. Each filter panel 53 can include at least one filtering screen and extends over at least part of the grain flow housing 40. Other filter means 50 can be mesh screens, mechanical, static electricity or magnetic separators for removing particles from a gas. Embodiments of FIGS. 1 and 4-6 show the filter panel 53 as planar. Alternatively, as in FIG. 3, the filter panel 53 can be comprised of two facets 55, each facet 55 being contained in a different plane.

FIG. 1 further shows the device 10 comprising a recovery column 52 in fluid connection with the grain flow housing 40 through the filter means 50, an air supplying means 54 in fluid connection with the recovery column 52 and the inlet port 12, and a recycle column 56 in fluid connection with the air supplying means 54 opposite the recovery column 52. The recycle column 56 is in fluid connection with the outlet port 14. A divider 58 separate the recovery column 52 from the recycle column 56. The air supplying means 54 can be a fan, air pump, or other air flow device. The fan has negative pressure on one side to draw air toward the fan and a positive pressure on the opposite side to blow air away from the fan.

Embodiments of the present invention also include a filter cleaning means 60, 60' positioned within the recovery column 52. FIG. 1 shows different embodiments of the filter cleaning means 60, 60'. The filter cleaning means 60 is comprised of a mobile blower 62, 62', a blower intake 64, 64', and a blower outlet 66, 66'. The mobile blower 62, 62' is in fluid connection with the recycle column 56 and the blower outlet 66, 66'. A conveying means 70 within the recovery column 52 connects to the mobile blower 62, 62'. FIG. 1 shows the filter cleaning means 60 in two different locations to illustrate the action of the conveying means 70. The conveying means 70 can be a pulley system 70 to raise and lower the mobile blower 62, 62' as in FIGS. 1 and 3 or a motor 70' on track as in FIGS. 1 and 4-6. The alternative motor 70' on a track is shown in a third location along the filter means 50 in FIG. 1.

Figure 3:
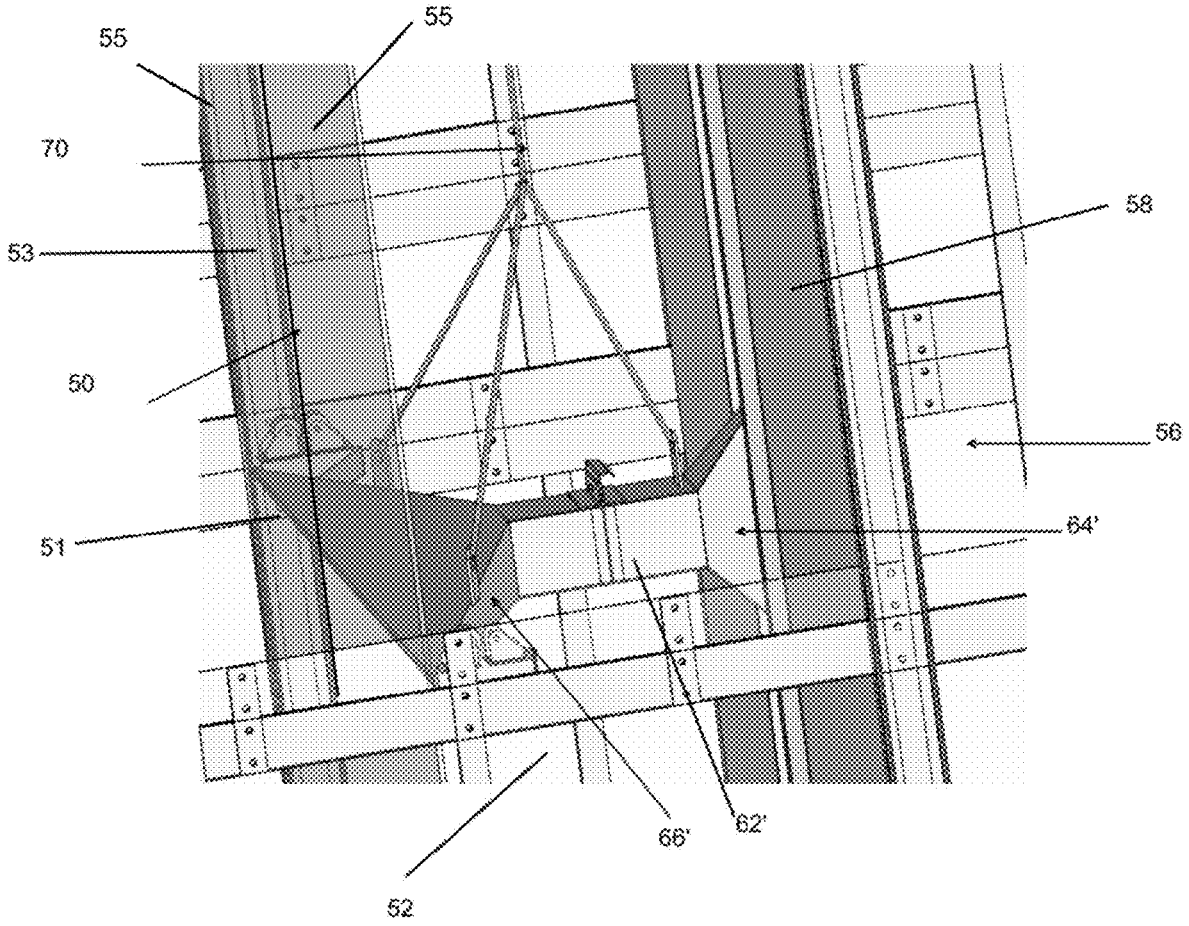
FIG. 3 is a partial perspective view of an embodiment of the filter cleaning means and conveying means.
Figure 6:
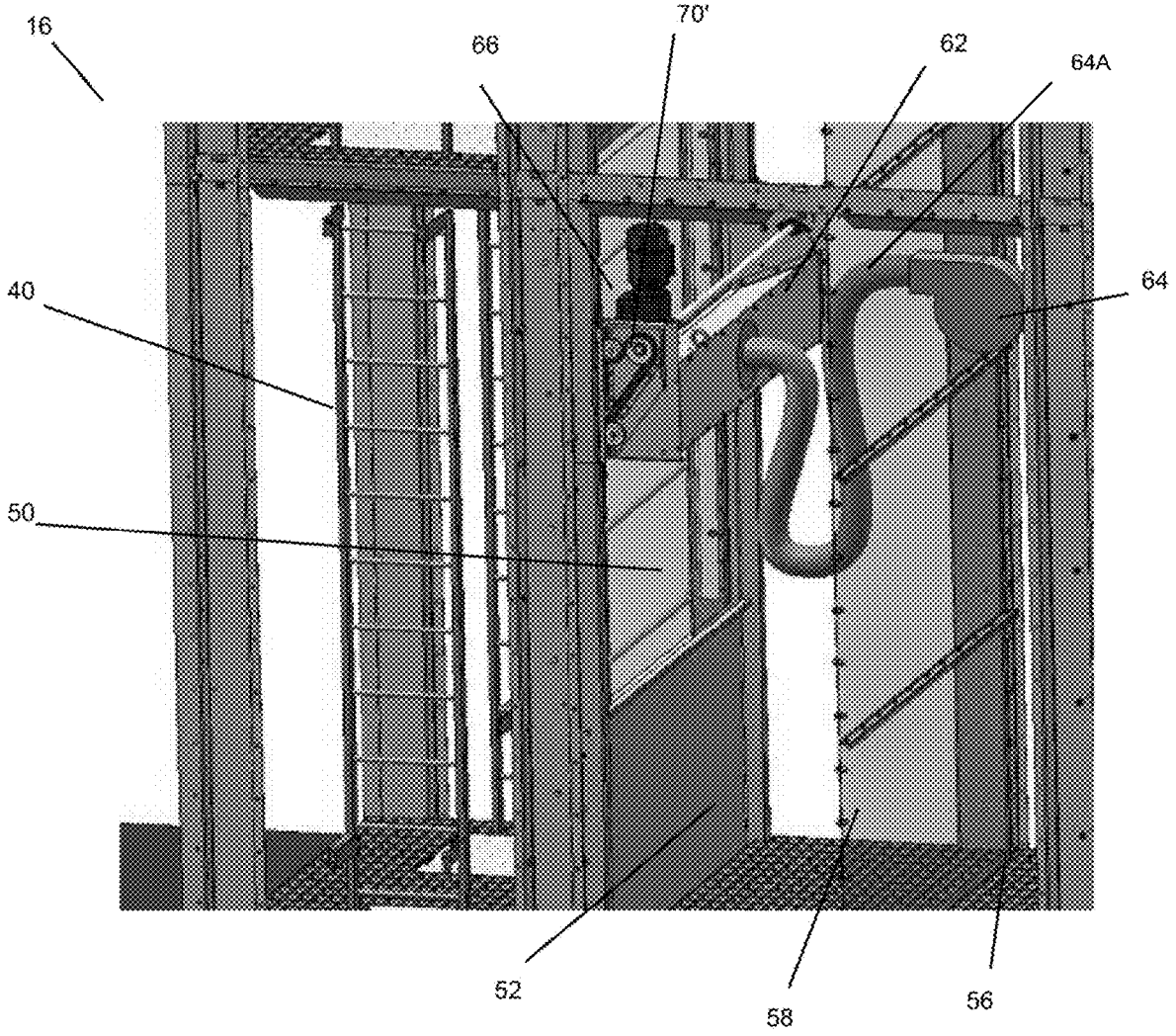
FIG. 6 is another partial perspective view of the other embodiments of the housing, grain flow housing, recycling column, recovery column, filter means, and another embodiment of a filter cleaning means.

There are also different embodiments of the mobile blower 62, 62'. FIGS. 4-6 show the blower intake 64 as a flexible conduit 64A with attachments to the mobile blower 62 and the recycle column 56. An alternative blower intake 64' is shown in FIGS. 1 and 3 as a cone or suction cone or baffle. The blower intake 64, 64' is sealed from the recovery column 52 through a divider 58 between the recovery column 52 and the recycle column 56. The blower intake 64, 64' receives air from the positive pressure side of the air supplying means 54. The blower outlet 66 is also shown as being flush to the filter means 50 in FIGS. 1 and 4-6. Alternatively, the blower outlet 66' can be shaped to fit the facets 55 in different planes.

FIG. 1 shows one embodiment to accommodate the second level of recycling relate to another pass through the grain flow. In this embodiment, the device 10 further comprises a third passageway 80 having a third entry end 82, a third exit end 84, and a second heating means 86. The recycle column 56 is in fluid connection with the third entry end 82 after the air supplying means 54, and the second heating means 86 is mounted within the third passageway 80. The second heating means 86 can be the same electric heating element or gas heating element of the first heating means 26. FIG. 1 shows the third exit end 84 in fluid connection with the second drying area 46. The heated air is further drying grains above the first drying area 44 in a second pass through the grain flow in the grain flow housing 40.

Another embodiment of FIG. 1 adds a fourth passageway 90 having a fourth entry end 92, a fourth exit end 94, and a third heating means 96. The recycle column 56 is in fluid connection with the fourth entry end 94 after the air supplying means 54, and the third heating means 96 is mounted within the fourth passageway 90. The third heating means 96 is similar to both the second heating means 86 and the first heating means 26, as an electric heating element, gas heating element, or other device to increase air temperature. FIG. 1 shows the fourth exit end 94 in fluid connection with the third drying area 48. The heated air is further drying grains above the second drying area 46 in the same second pass through the grain flow in the grain flow housing 40. There is a second pass through the grain flow to dry grain before the grain reaches the first drying area 44 and the cooling area 42.

In the embodiment for the second pass through the grain flow, the device 10 can further comprise an upper filter means 100 across the grain flow housing 40 from the third exit end 84 and fourth exit end 94, if there is a fourth passageway 90, an upper recovery column 102 in fluid connection with the grain flow housing 40 through the upper filter means 100, and an upper recycle column 106 in fluid connection with the upper recovery column 102 at one end of the upper recovery column 102. Similar to the filter means 50, the upper filtering means 100 can be comprised of an upper filter panel 103 or a plurality of filter panels 53 as in FIG. 1. Each upper filter panel 103 can include at least one filtering screen and extends over at least part of the grain flow housing 40. Other upper filter means 100 can be mesh screens, mechanical, static electricity or magnetic separators for removing particles from a gas. Embodiments of FIG. 1 show the upper filter panel 103 as planar.

With this embodiment with the upper filtering means 100, the device 10 can further includes an upper filter cleaning means 110 positioned within the upper recovery column 102 and being comprised of an upper mobile blower 112, an upper blower intake 114, and an upper blower outlet 116. Again analogous to the filter cleaning means 60, the upper mobile blower 112 is in fluid connection with the upper recycle column 106 and the upper blower outlet 116. The upper blower intake 112 is sealed from the upper recovery column 102 through an upper divider 108 between the upper recovery column 102 and the upper recycle column 106.

Figure 2:
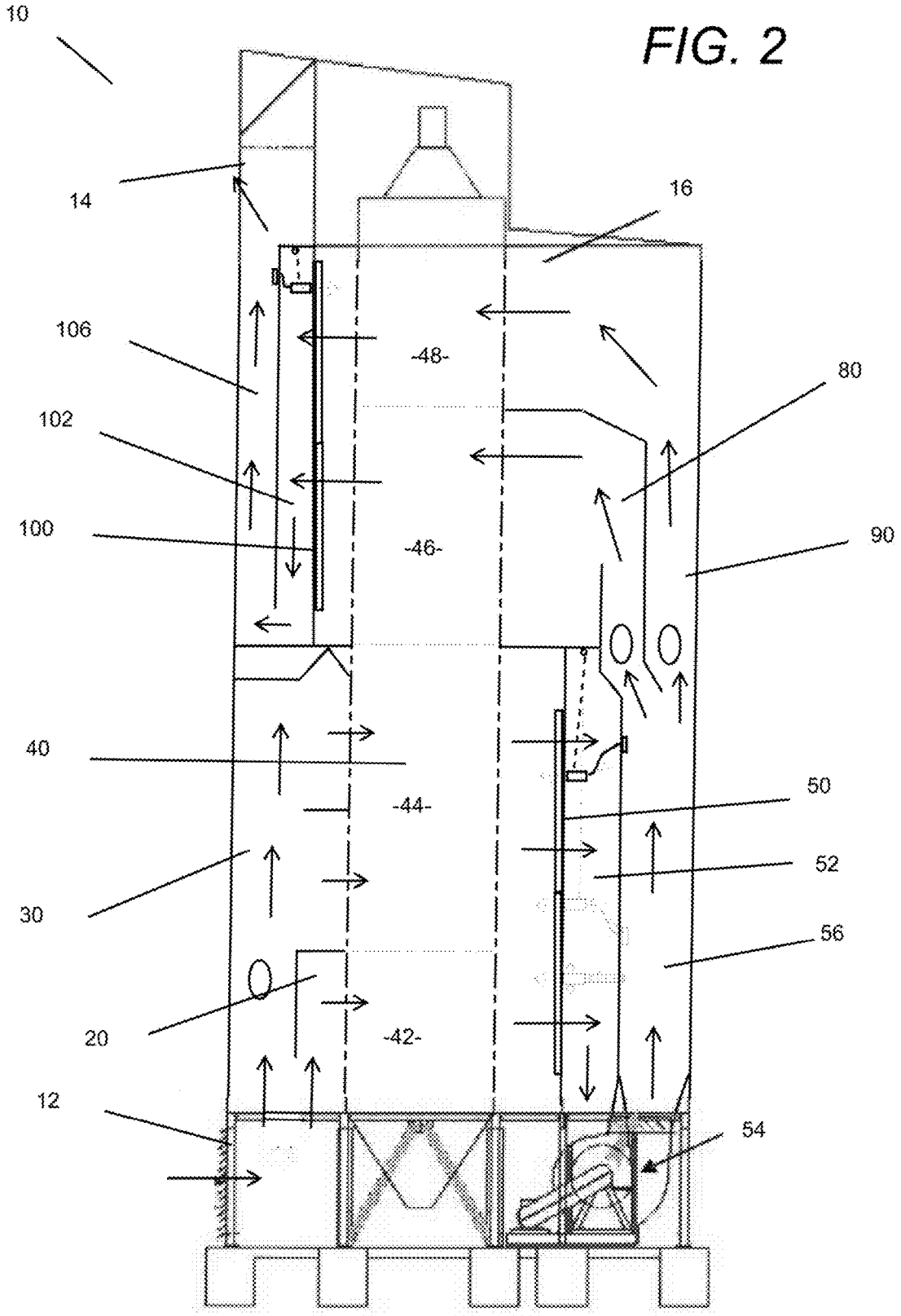
FIG. 2 is another schematic view of an embodiment of the device for drying grain, showing the air flow through the device by the method of the present invention.

Embodiments of the present invention include the method of drying grain. FIG. 2 shows the air flow through the device 10 for drying grain. The method includes assembling the device 10 and passing an external air flow into the housing 16 through the inlet port 12 by the air supplying means 54 with negative pressure. In the embodiment of the air supplying means 54 as a fan, the fan is oriented to draw air through the inlet port 12 and blow air through the outlet port 14.

A grain flow is poured through the grain flow housing 40 from the top to the bottom by gravity. The grain of the grain flow falls through the grain flow housing 40, and the air in the grain flow housing 40 dries the grain.

In the embodiments of the present invention, the method further comprises passing the external air flow through the grain flow in a direction perpendicular to a direction of the grain flow so as to form a first pass air flow. The first pass air flow dries the grain flow. FIG. 2 shows the step of passing the external air flow through the grain flow being comprised of the steps of: passing the external air flow through the first passageway 20 to the grain flow, and passing the external air flow through the second passageway 30 to the grain flow. The external air flow through the first and second passageways 20, 30 form the first pass through the grain flow housing 40. When there is the first heating means 26, the method includes the step of heating the external air flow through the second passageway 30. These steps correspond to the cooling area 42 being in fluid connection with the first exit end 24 with the external air at the same temperature and the first drying area 44 being in fluid connection with the second exit end 34 with the external air heated for drying the grain at a higher temperature.

The method further comprises the steps of filtering the first pass air flow with first air flow retaining particles through the filter means 50 so as to form a first filtered air flow in the recovery column 52. The first air flow retaining particles are retained by the filter means 50. The filter means 50 can be clogged and blocked by these particles, which affects efficiency of the method in terms of negative pressure to draw air into the device 10 and drying the grain.

Embodiments of the present invention include the two levels of recycling. The method includes directing a first portion of the first filtered flow to the recycle column 56 and directing a second portion of the first filtered flow from the recycle column 56 through the filter means 50 toward the grain flow so as to remove the first air flow retaining particles from the filter means 50. The first portion from the recycle column 56 is vented through the outlet port 14. The second portion from the recycle column 56 is re-used to clean the filter means 50.

In one embodiment, the step of directing the second portion of the first filtered flow comprises the steps of: collecting the second portion of the first filtered flow from the recycle column 56 with the blower intake 64 by negative pressure of the mobile blower 62, positioning the mobile blower 62 with the conveying means 70, and blowing the second portion through the section 51 of the filter means 50 aligned with the blower outlet 66 in a direction opposite to a direction of the first pass air flow through the filter means 50. The mobile blower 62 is within the recovery column 52 and aligned with a section 51 of the filter means 50. Only a section 51 of the filter means 50 is cleaned at one time, so there is no complete reversal of air flow at the filter means 50. The air supplying means 54 is more powerful than the mobile blower 62, but the mobile blower 62 is more restricted to an air flow only at the section 51, not the entire filter means 50. The conveyor means 70 actuates the mobile blower 62 along the filter means so that eventually the entire filter means 50 is cleaned. The device 10 does not require shut down in order to clean the filter means 50, and the device 10 can run more efficiently while being regularly and simultaneously cleaned.

FIG. 2 also shows an embodiment for further steps of directing the first portion of the first filtered flow as the second level of recycling. The first portion can be processed further before being vented to the outlet port 14. In these embodiments, the device 10 further comprises the third passageway 80 with the recycle column 56 being in fluid connection with the third entry end 82 after the air supplying means 54 and the second heating means 86 mounted within the third passageway 80. In the corresponding method, the step of directing the first portion of the first filtered flow comprises the steps of: passing the first portion from the recycle column 56 to the third passageway 80 by the air supplying means 54 by positive pressure, heating the first portion with the second heating means 86 within the third passageway 80, and passing the first portion through the grain flow in a direction perpendicular to a direction of the grain flow so as to form a second pass air flow from the third passageway 80. This second pass air flow dries the grain flow again. The third exit end 84 corresponds to the second drying area 46 above the first drying areas 44 of the grain flow housing. The second recycling is a second pass air flow.

FIG. 2 further shows the embodiment of the device comprising the fourth passageway 90 with the recycle column 56 being in fluid connection with the fourth entry end 92 after the air supplying means 54, and the third heating means 96 mounted within the fourth passageway 90. With the fourth passageway 90, the method includes passing the first portion from the recycle column 56 to the fourth passageway 90 by the air blowing means 54 by positive pressure concurrent with passing the first portion to the third passageway 80. The first portion is also heated with the third heating means 96 within the fourth passageway 90. The method includes passing the first portion through the grain flow in a direction perpendicular to a direction of the grain flow so as to form the second pass air flow from the fourth passageway 90 and the third passageway 80. This second pass air flow also dries the grain flow. The third exit end 86 corresponds to the second drying area 46, and the fourth exit end 96 corresponds to the third drying area 48.

Other embodiments include the method comprising the step of filtering the second pass air flow with second air flow retaining particles through the upper filter means 100 so as to form a second filtered air flow in the upper recovery column 102. The second air flow retaining particles are retained by the upper filter means 100. The device 10 must further comprise the upper filter means 100 across the grain flow housing 40 from the third exit end 86, the upper recovery column 102 in fluid connection with the grain flow housing 40 through the upper filter means 100, and the upper recycle column 108 in fluid connection with the upper recovery column 102 at one end of the upper recovery column 102. The second pass air flow is also filtered so that the particles are removed again for the second filtered air flow.

Consequently, another embodiment includes cleaning the upper filter means 100, when the device 10 further includes the upper filter cleaning means 120 positioned within the upper recovery column 102 and being comprised of an upper mobile blower 112, an upper blower intake 114, and an upper blower outlet 116. Analogous to the mobile blower 82, the upper mobile blower 112 is in fluid connection with the upper recycle column 106 and the upper blower outlet 116. Similar to the steps of cleaning the filter means 50, the steps of cleaning the upper filter means 110 include directing a first upper portion of the second filtered air flow to the upper recycle column 106, venting the first upper portion from the upper recycle column 106 through the outlet port 14, and directing a second upper portion of the second filtered air flow from the upper recycle column 106 through the upper filter means 110 toward the grain flow so as to remove the second air flow retaining particles from the upper filter means 100.

In the embodiment of FIG. 2, the step of directing the second upper portion of the second filtered flow comprises the steps of: collecting the second upper portion from the upper recycle column 106 with the upper blower intake 114 by negative pressure of the upper mobile blower 112, positioning the upper mobile blower 112 with the upper conveying means 120, and blowing the second upper portion through the section 101 of the upper filter means 100 aligned with the upper blower outlet 116 in a direction opposite to a direction of the second pass air flow through the upper filter means 100. The upper mobile blower 102 is within the upper recovery column 102 and aligned with the section 101 of the upper filter means 100.

In embodiments of the device 10 and method of the present invention, all of the air used in the lower portion of the housing 16 can be recycled so as to be re-used in the upper part of this same housing 16. Unlike traditional methods and devices, which rely on external air to mix with recycled air, the present invention does not rely on outside air. Generally, air from outside necessarily has a lower temperature than any internal recycled air that has already circulated through the grain flow housing 40. Therefore, in order to reach adequate temperature for drying grain, the external air requires a higher energy consumption than recycled air. Therefore, the method and the device according to the invention permit an improvement of the performance of drying of the grains.

In addition, part of the air recycled in the upper portion of the housing 40 in the second and third drying areas 46, 48, can be re-used in the lower portion of the housing 16 by the filter cleaning means 60. The device 10 fully re-uses the first filtered flow from the filter means 50. Furthermore, the embodiment of the filter panels 53 as planar simplifies the installation of device 10. Complicated, expensive and bulky suction devices requiring the installation of a piping, a motor and control cabinets is avoided. Instead, the filter cleaning means 60 of the present invention controls elimination particles and dust from the filter means 50 (and upper filter means 100), which are blown back towards the grain flow housing 40 for proper disposal or collection. The filter means 50 can be cleaned without interrupting the grain flow in the grain flow housing 40 and shut down of the device 10. The independence and separation of the mobile blower 62 continuously removes particles with air from the recycle column.

The invention is not limited to the examples shown and described above, which may have variants and modifications without departing from the scope of the invention.

The foregoing disclosure and description of the invention is illustrative and explanatory thereof. Various changes in the details of the illustrated construction can be made without departing from the true spirit of the invention.

I claim:

1. A device for drying grain, comprising:

a housing having an inlet port and an outlet port, said inlet port being in fluid connection with said outlet port;

a first passageway having a first entry end and a first exit end, said inlet port being in fluid connection with said first entry end;

a first heating means mounted within a second passageway;

said second passageway having a second entry end and a second exit end, said inlet port being in fluid connection with said second entry end;

a grain flow housing being comprised of a cooling area, a first drying area above said cooling area, a second drying area above said first drying area, and a third drying area above said second drying area;

a filter means across said grain flow housing from said first exit end and said second exit end;

a recovery column in fluid connection with said grain flow housing through said filter means;

an air supplying means in fluid connection with said recovery column and said inlet port;

a recycle column in fluid connection with said air supplying means opposite said recovery column, said recycle column being in fluid connection with said outlet port;

a filter cleaning means positioned within said recovery column and being comprised of a mobile blower, a blower intake, and a blower outlet, said mobile blower being in fluid connection with said recycle column and said blower outlet; and a conveying means within said recovery column and connected to said mobile blower.

2. The device for drying grain, according to claim 1, wherein said first exit end is in fluid connection with said cooling area, and wherein said second exit end is in fluid connection with said first drying area.

3. The device for drying grain, according to claim 1, wherein said blower intake is comprised of a conduit.

4. The device for drying grain, according to claim 1, wherein said blower intake is a cone.

5. The device for drying grain, according to claim 1, wherein said blower intake is sealed from said recovery column through a divider between said recovery column and said recycle column.

6. The device for drying grain, according to claim 1, further comprising:

a third passageway having a third entry end and a third exit end, said recycle column being in fluid connection with said third entry end after said air supplying means; and a second heating means within said third passageway.

7. The device for drying grain, according to claim 6, wherein said third exit end is in fluid connection with said second drying area.

8. The device for drying grain, according to claim 6, further comprising:

a fourth passageway having a fourth entry end and a fourth exit end, said recycle column being in fluid connection with said fourth entry end after said air supplying means; and a third heating means within said fourth passageway.

9. The device for drying grain, according to claim 8, wherein said fourth exit end is in fluid connection with said third drying area.

10. The device for drying grain, according to claim 6, further comprising:

an upper filter means across said grain flow housing from said third exit end;

an upper recovery column in fluid connection with said grain flow housing through said upper filter means; and an upper recycle column in fluid connection with said upper recovery column at one end of said upper recovery column.

11. The device for drying grain, according to claim 10, further comprising:

an upper filter cleaning means positioned within said upper recovery column and being comprised of an upper mobile blower, an upper blower intake, and an upper blower outlet, said upper mobile blower being in fluid connection with said upper recycle column and said upper blower outlet.

12. The device for drying grain, according to claim 11, wherein said upper blower intake is sealed from said upper recovery column through an upper divider between said upper recovery column and said upper recycle column.

13. A method for drying grain, comprising steps of:
assembling a device, according to claim 1;
passing an external air flow into said housing through said inlet port by said air supplying means with negative pressure;
pouring a grain flow through said grain flow housing;
passing said external air flow through said grain flow in a direction perpendicular to a direction of said grain flow so as to form a first pass air flow, said first pass air flow drying said grain flow;
filtering said first pass air flow with first air flow retaining particles through said filter means so as to form a first filtered air flow in said recovery column, said first air flow retaining particles being retained by said filter means;
directing a first portion of said first filtered flow to said recycle column;
directing a second portion of said first filtered flow from said recycle column through said filter means toward said grain flow so as to remove said first air flow retaining particles from said filter means; and
venting said first portion from said recycle column through said outlet port.

14. The method for drying grain, according to claim 13, wherein the step of passing said external air flow through said grain flow comprises steps of:
passing said external air flow through said first passageway to said grain flow; and
passing said external air flow through said second passageway to said grain flow.

15. The method for drying grain, according to claim 14, wherein the step of passing said external air flow through said grain flow comprises steps of:
heating said external air flow through said second passageway.

16. The method for drying grain, according to claim 13, wherein said device further comprises:
a third passageway having a third entry end and a third exit end, said recycle column being in fluid connection with said third entry end after said air supplying means;
a second heating means within said third passageway, and
wherein the step of directing said first portion of said first filtered flow comprises steps of:
passing said first portion from said recycle column to said third passageway by said air supplying means by positive pressure;
heating said first portion with said second heating means within said third passageway; and
passing said first portion through said grain flow in a direction perpendicular to a direction of said grain flow so as to form a second pass air flow from said third passageway, said second pass air flow drying said grain flow.

17. The method for drying grain, according to claim 16, wherein said device further comprises:
a fourth passageway having a fourth entry end and a fourth exit end, said recycle column being in fluid connection with said fourth entry end after said air supplying means; and
a third heating means within said fourth passageway, and
wherein the step of directing said first portion of said first filtered flow comprises steps of:
passing said first portion from said recycle column to said fourth passageway by said air blowing means by positive pressure;
heating said first portion with said third heating means within said fourth passageway; and
passing said first portion through said grain flow in a direction perpendicular to a direction of said grain flow so as to form said second pass air flow from said fourth passageway, said second pass air flow drying said grain flow.

18. The method for drying grain, according to claim 16, wherein the device further comprises:
an upper filter means across said grain flow housing from said third exit end;
an upper recovery column in fluid connection with said grain flow housing through said upper filter means; and
an upper recycle column in fluid connection with said upper recovery column at one end of said upper recovery column, and
wherein the step of directing said first portion of said first filtered flow further comprises steps of:
filtering said second pass air flow with second air flow retaining particles through said upper filter means so as to form a second filtered air flow in said upper recovery column, said second air flow retaining particles being retained by said upper filter means.

19. The method for drying grain, according to claim 18, wherein the device further comprises:
an upper filter cleaning means positioned within said upper recovery column and being comprised of an upper mobile blower, an upper blower intake, and an upper blower outlet, said upper mobile blower being in fluid connection with said upper recycle column and said upper blower outlet,
wherein the step of directing said first portion of said first filtered flow further comprises steps of:
directing a first upper portion of said second filtered air flow to said upper recycle column;
venting said first upper portion from said upper recycle column through said outlet port;
directing a second upper portion of said second filtered air flow from said upper recycle column through said upper filter means toward said grain flow so as to remove said second air flow retaining particles from said upper filter means, and
wherein the step of directing said second upper portion of said second filtered flow comprises steps of:
collecting said second upper portion from said upper recycle column with said upper blower intake by negative pressure;
positioning said upper mobile blower with said upper conveying means, said upper mobile blower being within said upper recovery column and aligned with a section of said upper filter means; and
blowing said second upper portion through said section of said upper filter means aligned with said upper blower outlet in a direction opposite to a direction of said second pass air flow through said upper filter means.

20. The method for drying grain, according to claim 13, wherein the step of directing said second portion of said first filtered flow comprises steps of:
collecting said second portion of said first filtered flow from said recycle column with said blower intake by negative pressure;

positioning said mobile blower with said conveying means, said mobile blower being within said recovery column and aligned with a section of said filter means; and blowing said second portion through said section of said filter means aligned with said blower outlet in a direction opposite to a direction of said first pass air flow through said filter means.

* * * * *